US012788163B2

(12) United States Patent
Hsu

(10) Patent No.: US 12,788,163 B2
(45) Date of Patent: Nov. 10, 2026

(54) GRAPHIC AND/OR THREADED BOTTLE CAP DISPLAY DEVICE

(71) Applicant: CCILU International Inc., Taipei City (TW)

(72) Inventor: Chia-Ming Hsu, Taipei City (TW)

(73) Assignee: CCILU International Inc., Taipei City (TW)

( * ) Notice: Subject to any disclaimer, the term of this patent is extended or adjusted under 35 U.S.C. 154(b) by 0 days.

(21) Appl. No.: 19/087,903

(22) Filed: Mar. 24, 2025

(65) Prior Publication Data

US 2026/0240345 A1 Aug. 20, 2026

(30) Foreign Application Priority Data

Feb. 18, 2025 (TW) ..... 114105880

(51) Int. Cl.
*A47F 7/00* (2006.01)
*A47G 1/12* (2006.01)

(52) U.S. Cl.
CPC . *A47F 7/00* (2013.01); *A47G 1/12* (2013.01)

(58) Field of Classification Search
CPC ..... A47F 7/00; A47G 1/12; G09F 19/00
See application file for complete search history.

(56) References Cited

U.S. PATENT DOCUMENTS 2,046,745 A * 7/1936 Hoag ..... B65D 51/245 401/128
2,730,262 A * 1/1956 Reams ..... B65D 51/242 220/301
2,953,970 A * 9/1960 Maynard ..... G02B 7/00 335/285
3,635,335 A * 1/1972 Kramer ..... A47G 1/12 206/0.82
3,649,069 A * 3/1972 Zip ..... B60J 3/02 160/DIG. 12
3,738,499 A * 6/1973 Takamizawa ..... B42D 17/005 211/120
4,063,639 A * 12/1977 Grant ..... B65D 73/005 206/0.82
5,895,018 A * 4/1999 Rielo ..... A47K 10/12 248/309.4
6,158,157 A * 12/2000 Hiscock ..... G09F 19/02 211/DIG. 1
6,174,075 B1 * 1/2001 Fuwausa ..... F21L 2/00 362/310
6,729,591 B2 * 5/2004 Hsu ..... G09F 7/04 248/205.6

(Continued)

*Primary Examiner* — Ko H Chan
(74) *Attorney, Agent, or Firm* — Wang Law Firm, Inc.

(57) ABSTRACT

A graphic and/or threaded bottle cap display device is applicable to products with flexible substrate layer, like footwear, backpacks, and clothing. The device features a display base equipped with an assembly groove and external threads, which is fixed to the product surface by a limiting piece or bottom plate portion. Fixing methods including adhesion, sewing, hot pressing, or magnetic attraction enable the display device to adapt to multiple installation methods on the surfaces of various products. This display device innovatively combines discarded bottle caps with characters or patterns, achieving a low-cost and personalized display effect. The display device supports the replacement of bottle caps to present diversified designs.

9 Claims, 7 Drawing Sheets

(56) References Cited

U.S. PATENT DOCUMENTS

| | | | | |
|---|---|---|---|---|
| 6,857,755 | B1 * | 2/2005 | Lewis | A44C 15/0015 362/249.06 |
| 7,377,061 | B2 * | 5/2008 | Whittier | G09F 13/04 40/574 |
| 7,748,569 | B2 * | 7/2010 | Sunatori | A47G 19/24 211/DIG. 1 |
| 8,196,221 | B2 * | 6/2012 | Fuwausa | A41D 27/08 81/3.15 |
| 9,618,032 | B2 * | 4/2017 | Woo | F16B 47/003 |
| 9,920,877 | B2 * | 3/2018 | Conti | F16M 13/027 |
| 10,520,009 | B2 * | 12/2019 | Smith | F16B 47/00 |
| 11,412,895 | B2 * | 8/2022 | Hudson | F16B 1/00 |
| 2006/0117462 | A1 * | 6/2006 | Wysopal | B67B 7/16 2/209.13 |
| 2009/0199325 | A1 * | 8/2009 | Fuwausa | A41D 27/08 2/244 |
| 2012/0223045 | A1 * | 9/2012 | Burke, Jr. | A61J 7/0472 215/228 |

* cited by examiner

GRAPHIC AND/OR THREADED BOTTLE CAP DISPLAY DEVICE

BACKGROUND

Field of the Invention

The present invention relates to a display device, and more particularly to a display device for displaying trademark graphics and/or threaded bottle caps.

Description of Related Art

In today's footwear manufacturing industry, most manufacturers adopt the original equipment manufacturing (OEM) production model, producing shoe bodies of the same or similar styles for different brands. Usually, specific trademarks are set on the shoe bodies for subsequent sales. However, different brands or customized requirements pose diversified demands on the trademark setting methods, which increases the complexity of the production process and further raises the OEM manufacturing cost.

Currently, there are various ways to present trademarks on shoe bodies, such as using embroidery, heat transfer, embossing, or adhesive technologies. However, these technologies require exclusive processes for different trademark designs. As a result, when carrying out brand-related processing on the same style of shoes, the production line needs to be adjusted, which is not only time-consuming and labor-intensive but also reduces production efficiency. Meanwhile, these traditional methods are particularly costly for processing small-batch orders or customized requirements.

On the other hand, with the increasing awareness of environmental protection, the recycling and reuse of PET bottles have received extensive attention. However, the current recycling systems mainly target the bottle bodies made of PET material, and the bottle caps made of PP material often fail to be effectively recycled and reused. This leads to a large number of PET bottle caps being discarded after use, failing to fully realize their recycling value and imposing a burden on the environment.

Based on the above background, it has become an urgent task to develop an innovative device that combines the functions of characters and/or patterns display with the reuse of PET bottle caps.

SUMMARY

To overcome the aforementioned technical problems, an object of the present invention is to provide a graphic and/or threaded bottle cap display device. The display device can be applied to the surfaces of various products with flexible substrate layers, such as footwear, backpacks, and clothing, enabling the arrangement of different trademarks through a single production method to meet personalized demands. Additionally, the display device innovatively utilizes discarded threaded bottle caps, achieving an environmentally friendly and playful design through the clever integration of characters and/or graphics. This reduces production costs and aligns with the requirements of green manufacturing.

To achieve the above-mentioned objective, the present invention provides a display device which is configured to be fixed on a surface of a flexible substrate layer of a product; wherein the display device comprises: a display base including a bottom plate portion, wherein an assembly groove is integrally formed on a surface of the bottom plate portion, the assembly groove has an inner wall surface and an outer wall surface opposite to each other; an external thread is formed on the outer wall surface; the outer wall surface of the assembly groove of the display base has a circular cross-section, the bottom plate portion is formed into a circular plate having a same center as the assembly groove, and an outer diameter of the bottom plate portion is larger than that of the assembly groove; the display base is fixed on the surface of the product through the bottom plate portion.

According to the present invention, the display base is fixed to the surface of the product through adhesion, stitching, heat pressing, riveting, ultrasonic welding, snap-fit installation, magnetic fixation, cold pressing, integrated injection molding, electromagnetic welding, buckle fixation, or tape fixation.

According to the present invention, the display device further includes a limiting piece with a through hole formed at a center thereof, the diameter of the through hole is larger than the maximum diameter of the assembly groove, the assembly groove penetrates the through hole, the display device is fixed to a surface of a flexible substrate layer of a product by sewing along a periphery of the limiting piece.

To achieve the above objective, the present invention further provides a display device, which comprises:

- a display base including a bottom plate portion, wherein an assembly groove is integrally formed on a surface of the bottom plate portion, the assembly groove has an inner wall surface and an outer wall surface opposite to each other; the inner wall surface includes a limiting groove, and the outer wall surface includes an external thread; the outer wall surface of the assembly groove of the display base is a groove body with a circular cross-section, and a limiting hole is formed at a center of the base plate portion;
- an adapter including a base, wherein a central column protrudes from a center of the base, an end of the central column is formed as a snap portion, and the central column contracts near the end to form an annular neck portion adjacent to the snap portion;
- a limiting piece including a through hole formed at a center thereof;
- wherein the central column of the adapter sequentially passes through the through hole of the limiting piece and the limiting hole of the display base; thereby, the display base and the adapter are fixed together by the snap portion extending into the assembly groove and engaging with a groove bottom surface of the assembly groove, such that the limiting piece is clamped between the display base and the adapter, and an outer diameter of the limiting piece is greater than a maximum outer diameter of the display base and a maximum outer diameter of the adapter.

According to the present invention, display device is fixed to a surface of a flexible substrate layer of a product by sewing along a periphery of the limiting piece.

According to the present invention, the inner wall surface of the assembly groove of the display base is formed as a groove body with a circular cross-section, a limiting groove is formed on the inner wall surface, the assembly groove is configured to accommodate and fix a graphic cover; the graphic cover is formed as a circular cover corresponding to the shape of the inner wall surface of the assembly groove, the graphic cover includes a display sealing portion and an annular wall circumferentially sealed around the periphery of the display sealing portion, a limiting rib is formed on an outer surface of the annular wall corresponding to the limiting groove of the display base; the graphic cover is snapped into the assembly groove, the limiting rib and the limiting groove are engaged in a concave-convex manner, and the display sealing portion is exposed within an opening of the assembly groove.

According to the present invention, the inner wall surface of the assembly groove of the display base is formed as a groove body with a circular cross-section, the assembly groove is configured to accommodate and fix a graphic cover; the graphic cover is formed as a circular cover corresponding to the shape of the inner wall surface of the assembly groove, the graphic cover includes a display sealing portion and an annular wall circumferentially sealed around the periphery of the display sealing portion, a limiting rib is formed on an outer surface of the annular wall corresponding to the limiting groove of the display base; the graphic cover is snapped into the assembly groove, the limiting rib and the limiting groove are engaged in a concave-convex manner, and the display sealing portion is exposed within an opening of the assembly groove.

According to the present invention, the external thread of the display base is configured to engage with a threaded bottle cap; the threaded bottle cap includes a top sealing portion and a side sealing portion, and an internal thread corresponding to the external thread of the display base is provided on an inner surface of the side sealing portion; the threaded bottle cap is screwed onto the display base through the engagement of the internal thread and the external thread.

According to the present invention, a material of the flexible substrate layer is selected from fabric, leather, flexible plastic, or a combination thereof.

According to the present invention, the aforementioned threaded bottle cap generally refers to the bottle cap with internal threads, and the threaded bottle cap can be a bottle cap for PET bottle, PP bottle, glass bottle or aluminum foil package; in addition, the external thread of the display base for engaging with the threaded bottle cap can be a single-turn thread, a 1.5-turn thread, a 2-turn thread, or a 2.5-turn thread, but is not limited thereto. Each of the above-mentioned values can be used as an endpoint value for another range.

As for the technologies, means and other functions adopted by the present invention to achieve the above-mentioned object, please refer to the detailed description of the preferred implementable embodiments in conjunction with the drawings as provided below.

DETAILED DESCRIPTION

To facilitate a better understanding of the present invention, the following description is made in conjunction with the embodiments shown in FIGS. 1 to 11.

Figure 1:
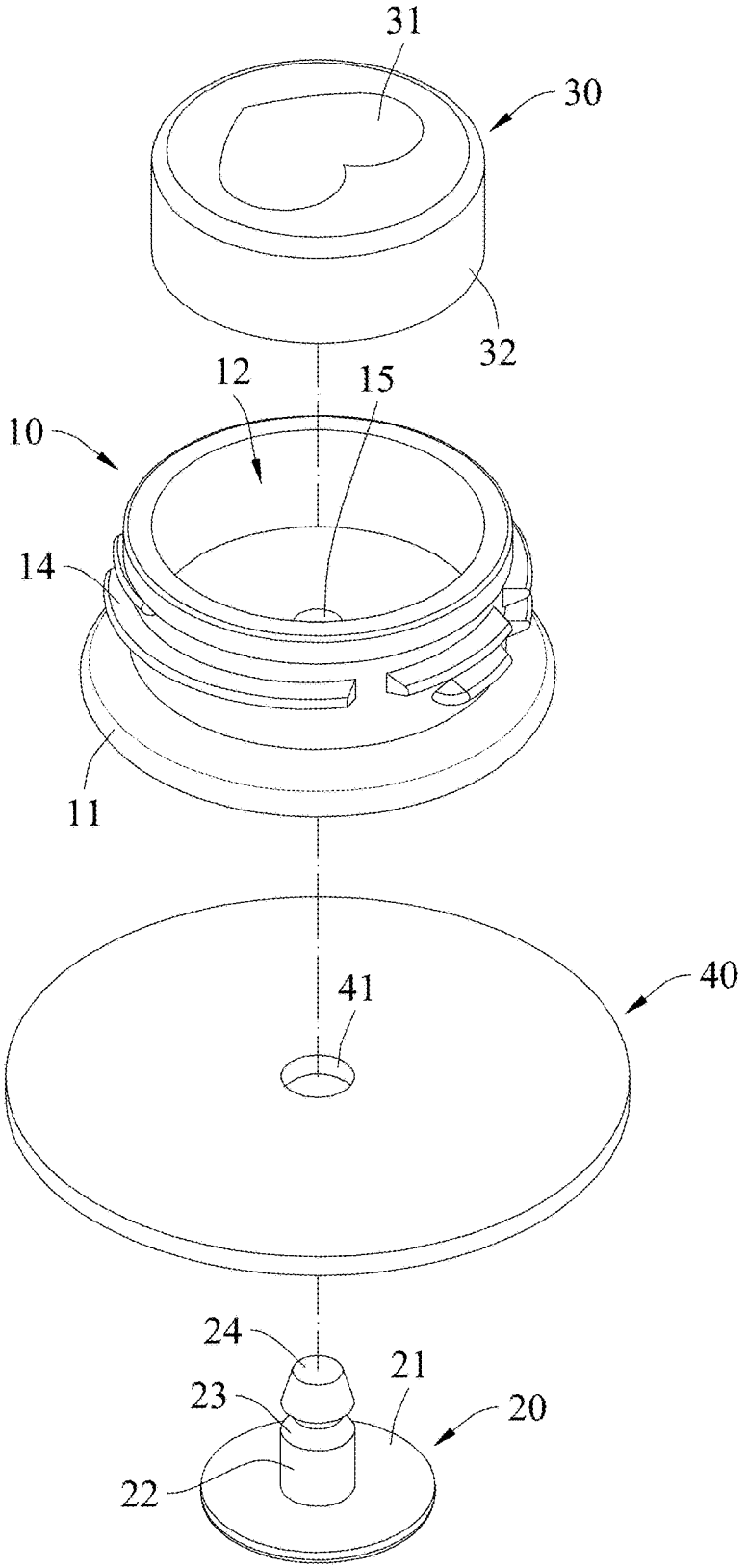
FIG. 1 is a schematic perspective exploded view of the first embodiment of the display device of the present invention.
Figure 2:
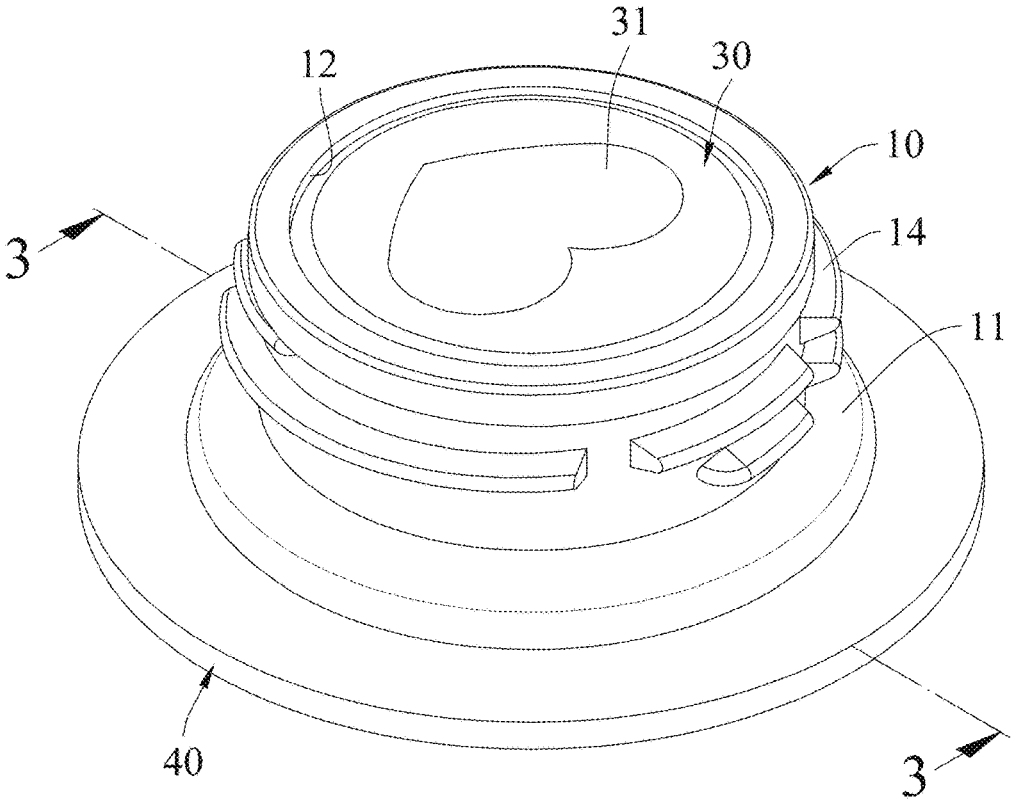
FIG. 2 is a schematic perspective assembled view of the first embodiment of the display device of the present invention.
Figure 3:
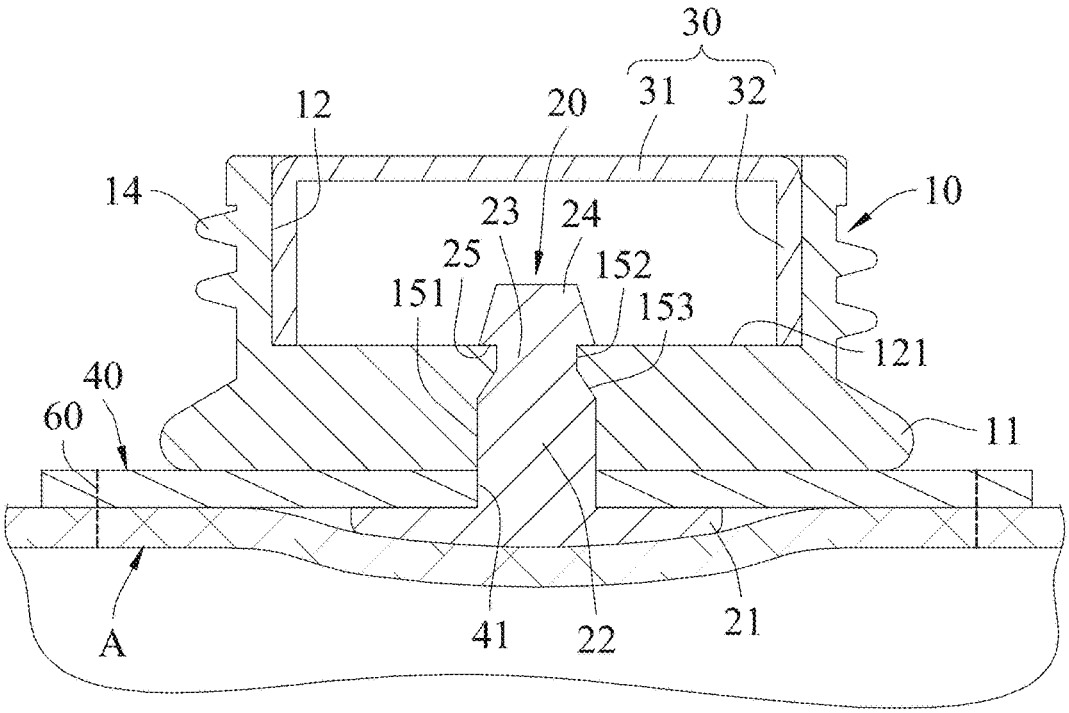
FIG. 3 is a schematic cross-sectional view taken along the line of 3-3 in FIG. 2 of the present invention.

As shown in FIGS. 1 to 3, the first embodiment of the graphic and/or threaded bottle cap display device of the present invention is shown. In the first embodiment, the display device mainly includes a display base 10, an adapter 20, and a limiting piece 40, which are used to display the characters and/or patterns of the trademark on a graphic cover 30.

As shown in FIG. 1, the display base 10 includes a bottom plate portion 11. An assembly groove 12 is integrally formed on the surface of the bottom plate portion 11. The assembly groove 12 includes opposite inner and outer wall surfaces; an external thread 14 is formed on the outer wall surface; both the inner and outer wall surfaces of the assembly groove 12 of the display base 10 are groove bodies with a circular cross-section, and a limiting hole 15 is provided at the center of the bottom plate portion 11. The adapter 20 includes a base 21. A central column 22 protrudes from the center of the base 21. The end of the central column 22 is formed into a snap portion 24. The central column 22 contracts near the end to form an annular neck portion 23 adjacent to the snap portion 24. A through hole 41 is provided at the center of the limiting piece 40.

As shown in FIGS. 2 and 3, the central column 22 of the adapter 20 sequentially inserts through the through hole 41 of the limiting piece 40 and the limiting hole 15 of the display base 10; thereby, the display base 10 and the adapter 20 are fixed together by the snap portion 24 extending into the assembly groove 12 and engaging with a groove bottom surface 121 of the assembly groove 12, such that the limiting piece 40 is clamped between the display base 10 and the adapter 20; as shown in FIG. 3, the display base 10 has the largest outer diameter at its bottom plate portion 11, and the adapter 20 has the largest outer diameter at its base 21; the outer diameter of the limiting piece 40 is larger than the largest outer diameters of the display base 10 and the adapter 20, so that the display device is sewn along the periphery of the limiting piece 40 by a sewing thread 60 and fixed on the surface of a flexible substrate layer A of a product, so that the base 21 of the adapter 20 is clamped and fixed between the limiting piece 40 and the flexible substrate layer A, and the display base 10 can be fixed on the surface of the flexible substrate layer A through the adapter 20 and the limiting piece 40.

In the embodiment of the present invention, the graphic cover 30 is installed in the assembly groove 12 of the display base 10 to achieve the display effect. Specifically, as shown in FIGS. 2 and 3, the graphic cover 30 is formed into a circular cover member corresponding to the shape of the inner wall surface of the assembly groove 12. The graphic cover 30 includes a display sealing portion 31 and an annular wall 32 that is circumferentially sealed around the periphery of the display sealing portion 31; the graphic cover 30 is snapped into the assembly groove 12, and the annular wall 32 of the graphic cover 30 is in close fit with the inner wall surface of the assembly groove 12, so that the display sealing portion 31 is exposed in the opening of the assembly groove 12, and at the same time, the characters and/or patterns formed on the outer surface of the display sealing portion 31 are placed in a display state.

As shown in FIG. 3, in the embodiment of the present invention, the limiting hole 15 of the display base 10 sequentially includes a large diameter portion 151, a necking portion 153, and a small diameter portion 152 along an opening direction from outside to inside; the central column 22 of the adapter 20 assembled through the limiting hole 15 includes an annular plane 25 adjacent between the snap portion 24 and the annular neck portion 23. When the central column 22 is inserted in the limiting hole 15, the central column 22 is mainly accommodated in the large diameter portion 151, the annular neck portion 23 is accommodated in the necking portion 153 and the small diameter portion 152, the snap portion 24 is accommodated in the assembly groove 12, and the annular plane 25 is abutted against the groove bottom surface of the assembly groove 12, which enhances the bonding strength between the display base 10 and the adapter 20, so as to effectively prevent the display base 10 from being separated from the adapter 20.

Figure 4:
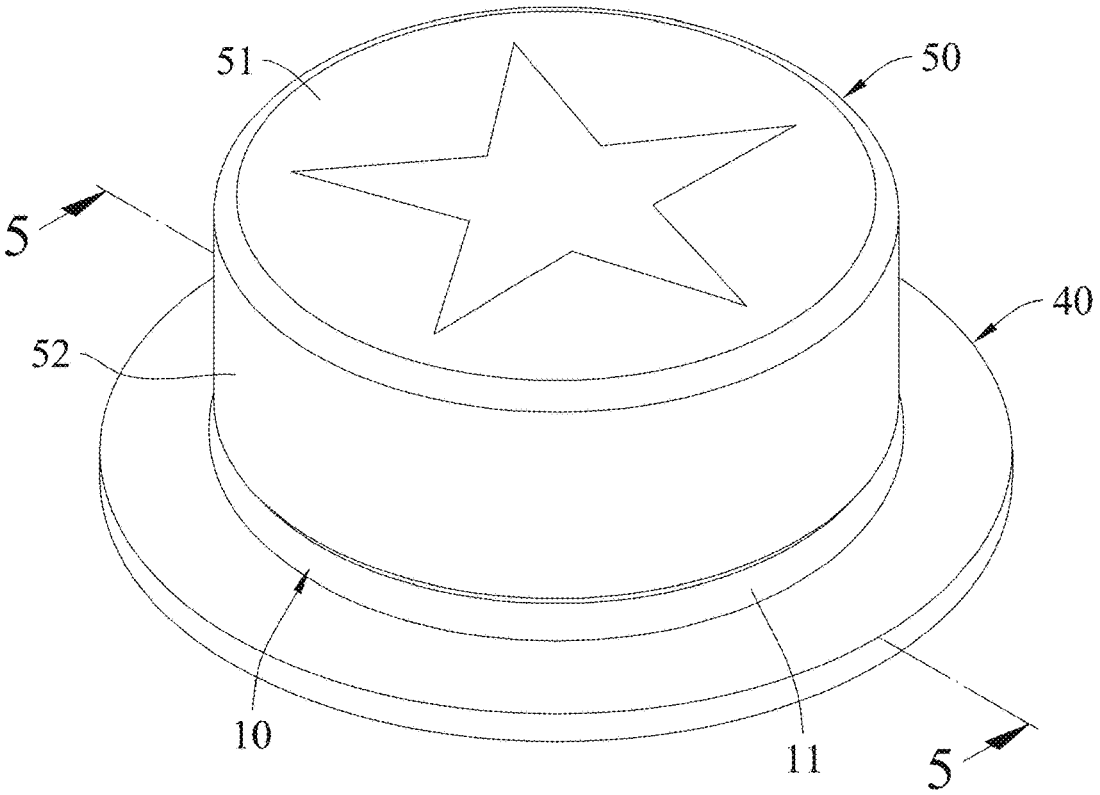
FIG. 4 is a schematic cross-sectional view showing the concave-convex fit between the display base of the display device and the graphic cover of the present invention.

In the first embodiment of the present invention, as shown in FIG. 4, the graphic cover 30 and the display base 10 can be assembled and positioned through a concave-convex fit, further ensuring the bonding strength between the graphic cover 30 and the display base 10. Specifically, the display base 10 can include a limiting groove 13 on an inner wall surface thereof; the annular wall 32 of the graphic cover 30 can include a limiting rib 33 on an outer surface thereof corresponding to the limiting groove 13 of the display base 10; the graphic cover 30 is snapped into the assembly groove 12, the limiting rib 33 is buckled in the limiting groove 13 in a concave-convex fit, and the display sealing portion 31 is exposed in the opening of the assembly groove 12. Furthermore, the concave-convex fit structure formed by the limiting groove and the limiting rib can be formed on the annular wall 32 of the graphic cover 30 and the inner wall surface of the assembly groove 12 in the opposite way. In addition, the limiting groove 13 and the limiting rib 33 can be formed into a continuous annular concave-convex fit structure in a complete circular shape, or can be formed into concave-convex fit structures arranged at intervals.

Figure 5:
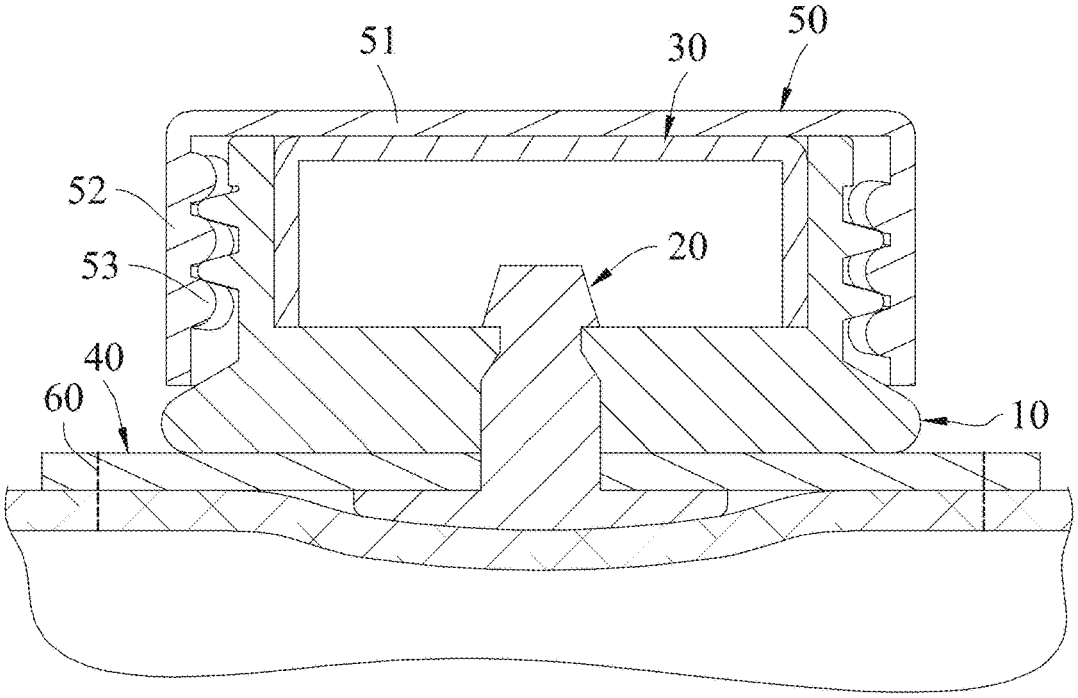
FIG. 5 is a schematic perspective external view of the display device of the present invention combined with a bottle cap.
Figure 6:
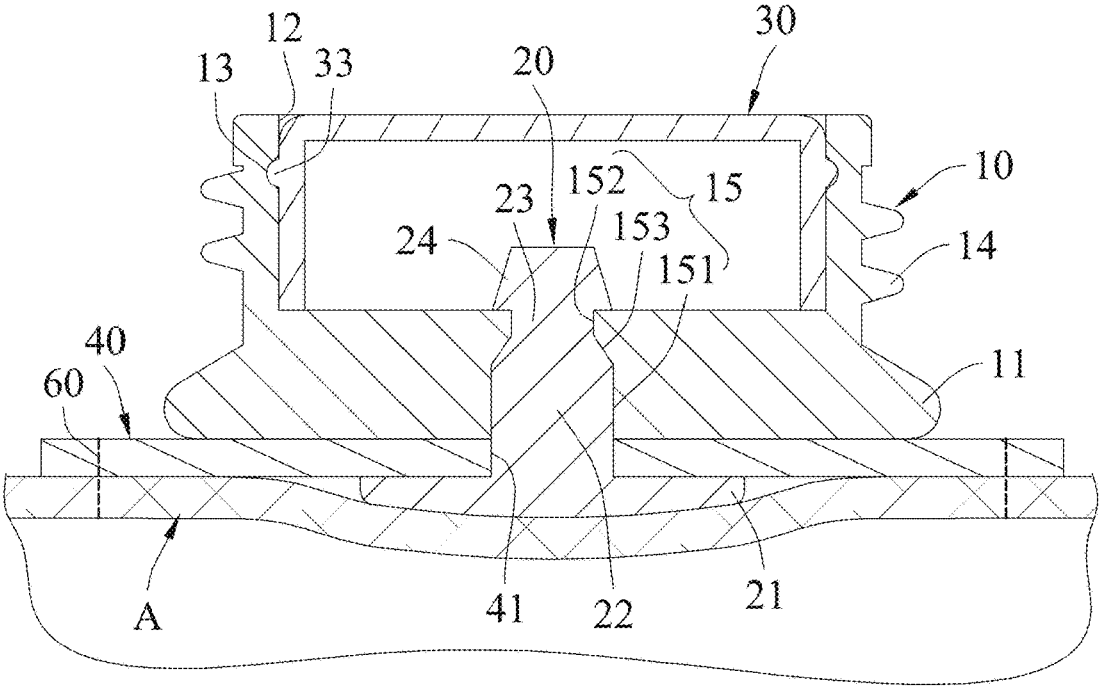
FIG. 6 is a schematic cross-sectional view taken along the line of 5-5 in FIG. 4 of the present invention.

In the first embodiment of the present invention, as shown in FIGS. 5 and 6, the external thread 14 of the display base 10 is configured to engage with a threaded bottle cap 50; the threaded bottle cap 50 includes a top sealing portion 51 and a side sealing portion 52, and an internal thread 53 corresponding to the external thread 14 of the display base 10 is provided on an inner surface of the side sealing portion 52; the threaded bottle cap 50 is screwed and combined with the external thread 14 of the display base 10 through the internal thread 53.

In the embodiment of the present invention, the threaded bottle cap 50 is preferably the bottle cap of a PET bottle, but is not limited thereto. Specifically, the maximum outer diameter (including the thickness of the external thread 14) of the assembly groove 12 of the display base 10 is approximately 28 millimeters (mm), and the external thread 14 on the outer wall surface of the assembly groove 12 can be a single-turn thread (360°), a 1.5-turn thread (540°), or a 2-turn thread (720°).

Figure 7:
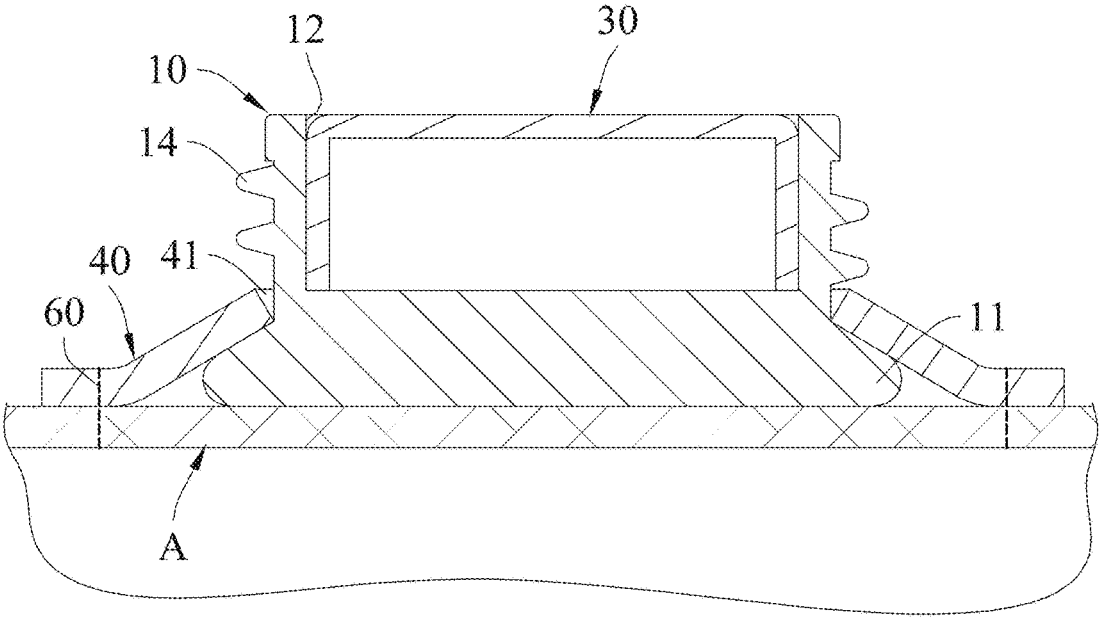
FIG. 7 is a schematic cross-sectional view of the second embodiment of the display device of the present invention assembled on the surface of a flexible substrate layer.

As shown in FIG. 7, the second embodiment of the graphic and/or threaded bottle cap display device of the present invention is shown; the main difference between the second embodiment and the first embodiment is that the display base 10 is not installed through the adapter 20, but the display base 10 itself is assembled to the flexible substrate layer A. In the second embodiment, the display base 10 includes a bottom plate portion 11. An assembly groove 12 is integrally formed on the surface of the bottom plate portion 11. The assembly groove 12 has opposite inner and outer wall surfaces; an external thread 14 is formed on the outer wall surface; the outer wall surface of the assembly groove 12 of the display base 10 is a groove body with a circular cross-section, the bottom plate portion 11 is formed into a circular plate having the same center as the assembly groove 12, and the outer diameter of the bottom plate portion 11 is larger than that of the assembly groove 12; the display base 10 is installed and fixed on the surface of the product through the bottom plate portion 11.

In the second embodiment, the bottom plate portion 11 can be directly adhered to the flexible substrate layer A through known technical means, or can be sewn and fixed on the flexible substrate layer A in combination with the limiting piece 40. Specifically, as shown in FIG. 7, the limiting piece 40 has a through hole 41 through which the assembly groove 12 can pass; the display base 10 penetrates the through hole 41 with its assembly groove 12; as shown in FIG. 7, the display base 10 has the maximum outer diameter at its bottom plate portion 11, and the outer diameter of the limiting piece 40 is larger than the maximum outer diameters of the display base 10 and the adapter 20, so that the display device is sewn along the periphery of the limiting piece 40 by a sewing thread 60 and fixed on the surface of a flexible substrate layer A of a product, so that the bottom plate portion 11 of the display base 10 is clamped and fixed between the limiting piece 40 and the flexible substrate layer A, and the display base 10 can be directly fixed on the surface of the flexible substrate layer A through the limiting piece 40.

Figure 8:
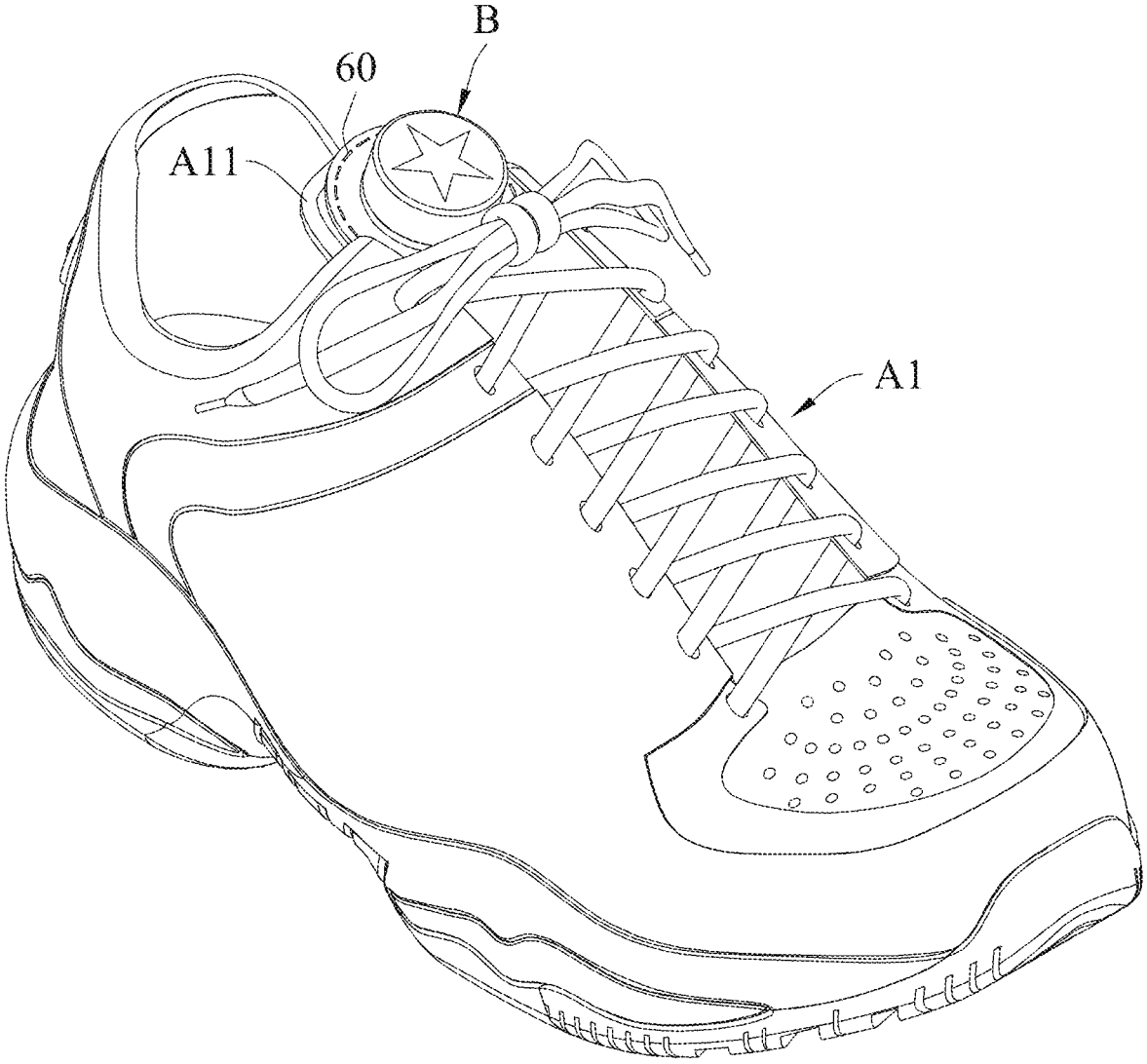
FIG. 8 is a schematic perspective external view of the display device of the present invention arranged on the tongue of a shoe.
Figure 9:
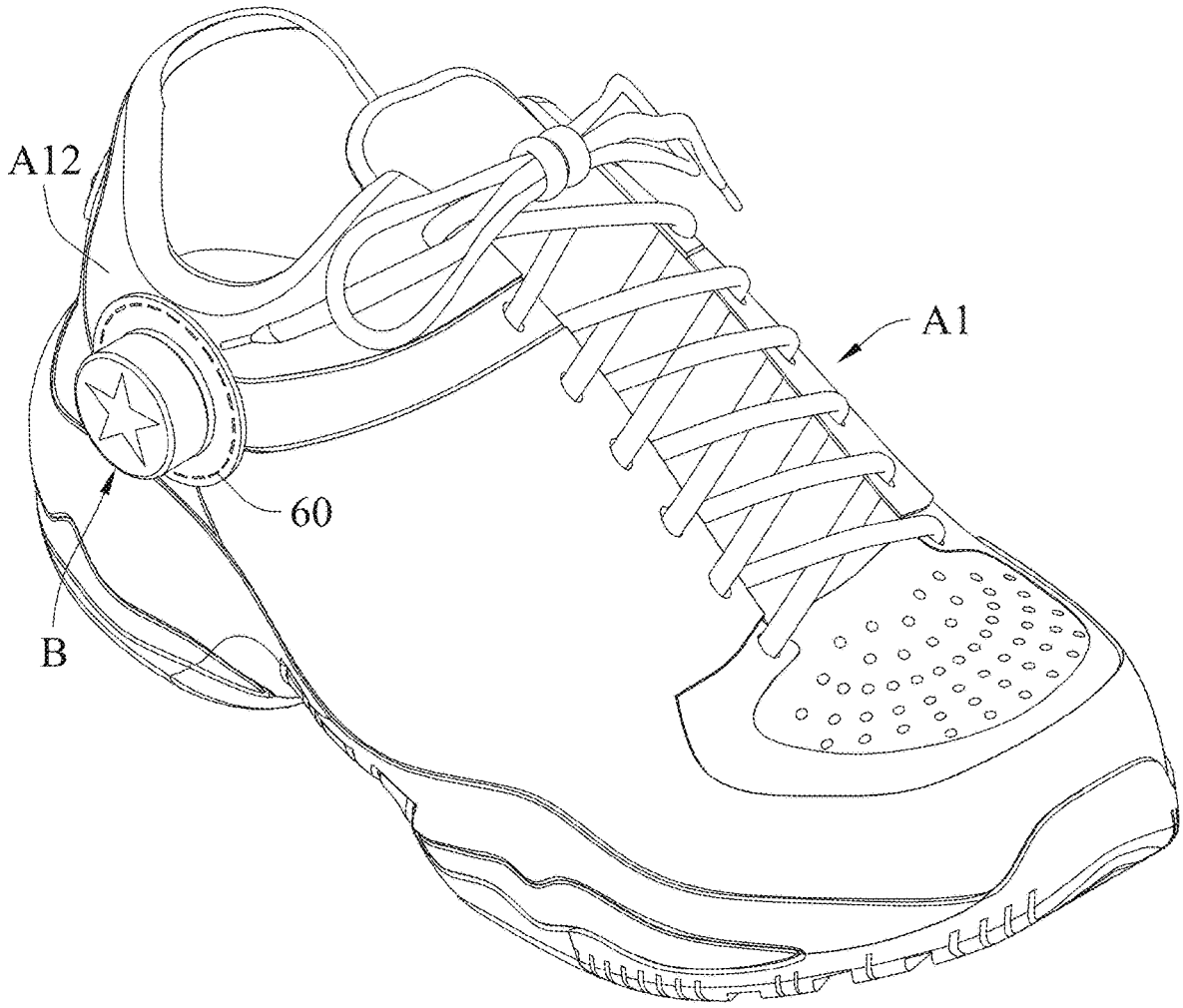
FIG. 9 is a schematic perspective external view of the display device of the present invention arranged on the lateral outer surface of a shoe body.
Figure 10:
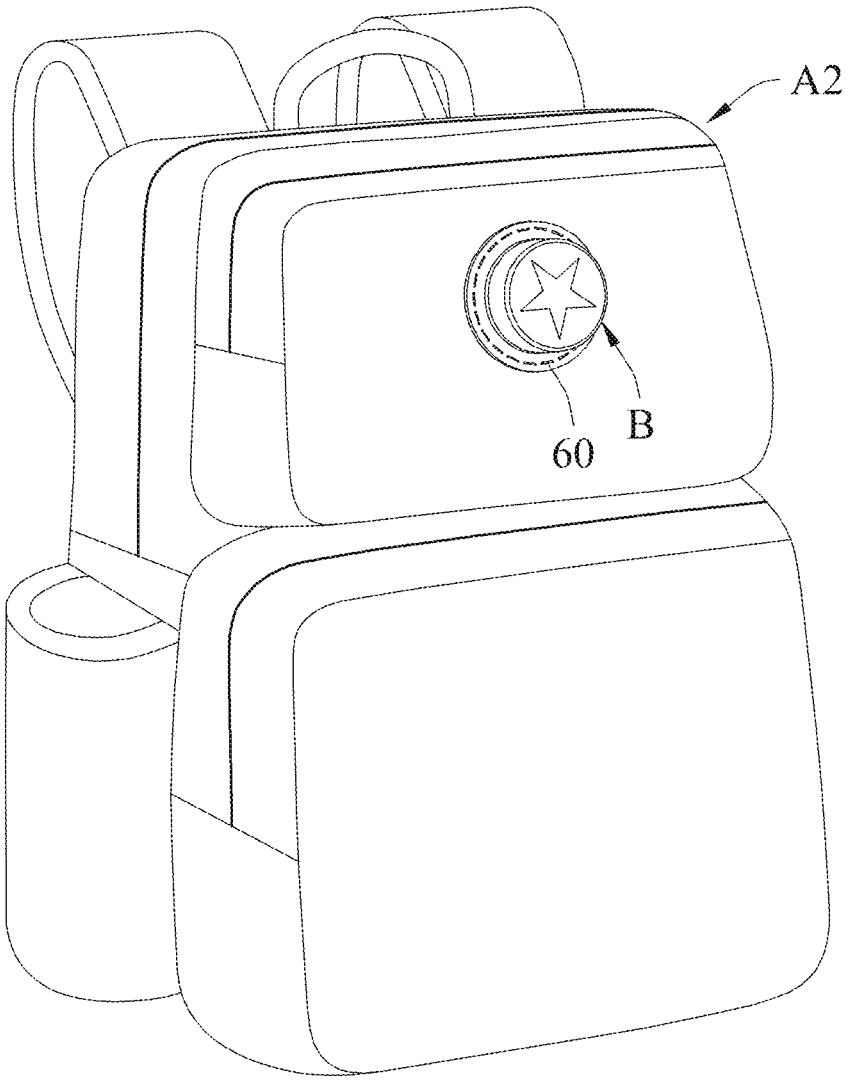
FIG. 10 is a schematic perspective external view of the display device of the present invention arranged on the outer surface of a backpack.

As shown in FIGS. 8 to 10, the graphic and/or threaded bottle cap display device of the present invention applied to different products is shown. The graphic and/or threaded bottle cap display device of the present invention can be applied and installed on products with a flexible substrate layer A. The products can be, for example, a shoe body A1 (FIGS. 8 and 9), a backpack A2 (FIG. 10), or clothing; the flexible substrate layer A can be selected from materials such as fabric, leather, or flexible plastic. Specifically, as shown in FIG. 8, it shows that the display device B is sewn and fixed on the tongue A11 of the shoe; as shown in FIG. 9, it shows that the display device B is sewn and fixed on the side A12 of the shoe; as shown in FIG. 10, it shows that the display device B is sewn and fixed on the front surface of the backpack A2. Thereby, by only installing the graphic cover 30 in the assembly groove 12 of the display base 10, the characters or patterns of the trademark of the product can be displayed. Alternatively, the user can replace different PET bottle caps at any time according to personal preferences, so as to display a unique design pattern on the product.

In summary, the "graphic and/or threaded bottle cap display device" provided by the present invention aims to combine environmental protection, innovation, and practicality to provide personalized and differentiated design solutions for various products (such as footwear, backpacks, and clothing) with a flexible substrate layer. The display device cleverly uses discarded threaded bottle caps and combines with replaceable characters and/or patterns of the trademark, which not only gives a second life to the waste, achieves environmental benefits, but also adds fun to use with its flexible display function, and meets the needs of consumers for personalized products. The device has a simple design, supports a variety of fixing processes (such as adhesion, ultrasonic welding, sewing, etc.), can be stably installed on the surface of the product, and has a stable structure and is not easy to fall off. The modular design further improves the convenience of use. Users can easily replace the display cover or the threaded bottle cap, and display various design patterns at any time.

In addition, the size and structural design of the device is compatible with various specifications of threaded bottle caps (such as PET bottle caps), and is suitable for flexible substrates of different materials such as fabric, leather, and flexible plastic, with a wide application range. Through the precise concave-convex fit structure, it ensures the display stability and clarity, and at the same time reduces the production cost, meets the requirements of green production, and supports sustainable development. The invention not only improves the functionality and attractiveness of the product, but also embodies the integration of environmental protection and innovative design, and has significant market value.

What is claimed is:

1. A display device configured to be fixed on a surface of a flexible substrate layer of a product; wherein the display device comprises:

a display base including a bottom plate portion, wherein an assembly groove is integrally formed on a surface of the bottom plate portion, the assembly groove has an inner wall surface and an outer wall surface opposite to each other; an external thread is formed on the outer wall surface; the outer wall surface of the assembly groove of the display base has a circular cross-section, the bottom plate portion is formed into a circular plate having a same center as the assembly groove, and an outer diameter of the bottom plate portion is larger than that of the assembly groove; the display base is fixed on the surface of the product through the bottom plate portion;

wherein the inner wall surface of the assembly groove of the display base is formed as a groove body with a circular cross-section, a limiting groove is formed on the inner wall surface, the assembly groove is configured to accommodate and fix a graphic cover; the graphic cover is formed as a circular cover corresponding to the shape of the inner wall surface of the assembly groove, the graphic cover includes a display sealing portion and an annular wall circumferentially sealed around the periphery of the display sealing portion, a limiting rib is formed on an outer surface of the annular wall corresponding to the limiting groove of the display base; the graphic cover is snapped into the assembly groove, the limiting rib and the limiting groove are engaged in a concave-convex manner, and the display sealing portion is exposed within an opening of the assembly groove.

2. The display device as claimed in claim 1, wherein the external thread of the display base is configured to engage with a threaded bottle cap; the threaded bottle cap includes a top sealing portion and a side sealing portion, and an internal thread corresponding to the external thread of the display base is provided on an inner surface of the side sealing portion; the threaded bottle cap is screwed onto the display base through the engagement of the internal thread and the external thread.

3. The display device as claimed in claim 1, wherein a material of the flexible substrate layer is selected from fabric, leather, flexible plastic, or a combination thereof.

4. The display device as claimed in claim 1, wherein the display base is fixed to the surface of the product through adhesion, stitching, heat pressing, riveting, ultrasonic welding, snap-fit installation, magnetic fixation, cold pressing, integrated injection molding, electromagnetic welding, buckle fixation, or tape fixation.

5. A display device, comprising:

a display base including a bottom plate portion, wherein an assembly groove is integrally formed on a surface of the bottom plate portion, the assembly groove has an inner wall surface and an outer wall surface opposite to each other; the inner wall surface includes a limiting groove, and the outer wall surface includes an external thread; the outer wall surface of the assembly groove of the display base is a groove body with a circular cross-section, and a limiting hole is formed at a center of the base plate portion;

an adapter including a base, wherein a central column protrudes from a center of the base, an end of the central column is formed as a snap portion, and the central column contracts near the end to form an annular neck portion adjacent to the snap portion;

a limiting piece including a through hole formed at a center thereof;

wherein the central column of the adapter sequentially passes through the through hole of the limiting piece and the limiting hole of the display base; thereby, the display base and the adapter are fixed together by the snap portion extending into the assembly groove and engaging with a groove bottom surface of the assembly groove, such that the limiting piece is clamped between the display base and the adapter, and an outer diameter of the limiting piece is greater than a maximum outer diameter of the display base and a maximum outer diameter of the adapter.

6. The display device as claimed in claim 5, wherein the display device is fixed to a surface of a flexible substrate layer of a product by sewing along a periphery of the limiting piece.

7. The display device as claimed in claim 5, wherein the inner wall surface of the assembly groove of the display base is formed as a groove body with a circular cross-section, the assembly groove is configured to accommodate and fix a graphic cover; the graphic cover is formed as a circular cover corresponding to the shape of the inner wall surface of the assembly groove, the graphic cover includes a display sealing portion and an annular wall circumferentially sealed around the periphery of the display sealing portion, a limiting rib is formed on an outer surface of the annular wall corresponding to the limiting groove of the display base; the graphic cover is snapped into the assembly groove, the limiting rib and the limiting groove are engaged in a concave-convex manner, and the display sealing portion is exposed within an opening of the assembly groove.

8. The display device as claimed in claim 5, wherein the external thread of the display base is configured to engage with a threaded bottle cap; the threaded bottle cap includes a top sealing portion and a side sealing portion, and an internal thread corresponding to the external thread of the display base is provided on an inner surface of the side sealing portion; the threaded bottle cap is screwed onto the display base through the engagement of the internal thread and the external thread.

9. The display device as claimed in claim 6, wherein a material of the flexible substrate layer is selected from fabric, leather, flexible plastic, or a combination thereof.

* * * * *